US006334429B1

(12) United States Patent
Little, Jr.

(10) Patent No.: US 6,334,429 B1
(45) Date of Patent: Jan. 1, 2002

(54) INTEGRATED LOST MOTION ROCKER BRAKE WITH CONTROL VALVE FOR LOST MOTION CLIP/RESET

(75) Inventor: Richard J. Little, Jr., Montgomery, MA (US)

(73) Assignee: Diesel Engine Retarders, Christiana, DE (US)

( * ) Notice: Subject to any disclaimer, the term of this patent is extended or adjusted under 35 U.S.C. 154(b) by 0 days.

(21) Appl. No.: 09/665,577

(22) Filed: Sep. 18, 2000

Related U.S. Application Data

(60) Provisional application No. 60/154,474, filed on Sep. 17, 1999, and provisional application No. 60/172,138, filed on Dec. 17, 1999.

(51) Int. Cl.[7] ..... F02D 1/00

(52) U.S. Cl. ..... 123/320; 123/321

(58) Field of Search ..... 123/320, 321

(56) References Cited

U.S. PATENT DOCUMENTS

| | | | | |
|---|---|---|---|---|
| 3,220,392 A | | 11/1965 | Cummins | |
| 3,332,405 A | | 7/1967 | Haviland | |
| 3,367,312 A | | 2/1968 | Jonsson | |
| 4,251,051 A | | 2/1981 | Quenneville et al. | |
| 4,475,500 A | | 10/1984 | Bostelman | |
| 4,996,957 A | | 3/1991 | Meistrick | |
| 5,386,809 A | | 2/1995 | Reedy et al. | |
| 5,526,784 A | * | 6/1996 | Hakkenberg et al. | 123/321 |
| 5,537,976 A | * | 7/1996 | Hu | 123/322 |
| 5,794,589 A | * | 8/1998 | Hakansson | 123/321 |
| 5,839,453 A | * | 11/1998 | Hu | 123/321 |
| 6,240,898 B1 | * | 6/2001 | Meistrick et al. | 123/321 |

* cited by examiner

*Primary Examiner*—John Kwon
(74) *Attorney, Agent, or Firm*—Collier Shannon Scott, PLLC

(57) ABSTRACT

The present invention is directed to a control value 20 which incorporates the functions of both a shuttle valve and a check valve into a single structure for use in a lost motion engine brake system. In response to a supply of hydraulic fluid from switched low pressure supply circuit 320, control valve body 200 of control value 20 may index within control valve bore 204, such that hydraulic fluid flows through upper annulus 260, first horizontal bore 270, first vertical bore 280, middle annulus 261 and out through lashless fluid supply circuit 340 and accumulator control circuit 350 to acuate engine valve 100. In an embodiment for clipping/rest of the valve actuating piston 130, clipping/reset spool 450 provided in rocker shaft 405. In response to rotational or linear motion, spool annuluses 451 on clipping/reset spool 450 move to open and close clipping reset/passageway 455 and accumulator control circuit 350, thereby providing clipping of piston 130.

10 Claims, 8 Drawing Sheets

INTEGRATED LOST MOTION ROCKER BRAKE WITH CONTROL VALVE FOR LOST MOTION CLIP/RESET

CROSS REFERENCE TO RELATED APPLICATIONS

This application relates to and claims priority on U. S. Provisional Applications Ser. No. 60/154,474, entitled "CHECK/SHUTTLE VALVE (CONTROL VALVE) FOR AN INTEGRATED LOST MOTION ROCKER BRAKE," filed on Sep. 17, 1999 and Ser. No. 60/172,138, entitled "VALVE FOR LOST MOTION CLIP/RESET LOCATED IN THE ROCKER SHAFT," filed on Dec. 17, 1999.

FIELD OF THE INVENTION

The present invention relates generally to the control of exhaust and intake valves during positive power and engine braking. In particular, the present invention is directed to a control valve that combines a check valve and a shuttle valve for use in a lost motion engine brake system. The present invention is also directed to a system and method to allow the clipping or resetting of a lost motion engine brake system.

BACKGROUND OF THE INVENTION

For many internal combustion engine applications, such as for powering heavy trucks, it is desirable to operate the engine in a braking mode. This approach involves converting the engine into a compressor by cutting off the fuel flow and opening the exhaust valve for each cylinder near the end of the compression stroke.

An early technique for accomplishing the braking effect is disclosed in U.S. Pat. No. 3,220,392 to Cummins, wherein a slave hydraulic piston located over an exhaust valve opens the exhaust valve near the end of the compression stroke of an engine piston with which the exhaust valve is associated. To place the engine into braking mode, the three-way solenoids are energized, which causes pressurized lubricating oil to flow through a control valve, creating a hydraulic link between a master piston and a slave piston. The master piston is displaced inward by an engine element (such as a fuel injector actuating mechanism) periodically in timed relationship with the compression stroke of the engine which in turn actuates a slave piston through hydraulic force to open the exhaust valves. The compression brake system as originally disclosed in the '392 patent has evolved in many aspects, including improvements on the control valves (see, for example, U.S. Pat. No. 5,386,809 to Reedy et al.; see also U.S. Pat. No. 4,996,957 to Meistrick, which is assigned to the assignee of the present application and incorporated herein by reference.) Improvements have also been made in the piston actuation assembly (see U.S. Pat. No. 4,475,500 to Bostelman). In a typical modem compression braking system, the exhaust valves are normally operated during the engine's power mode by an exhaust rocker lever. To operate the engine in a braking mode, a control valve separates the braking system into a high pressure circuit and a low pressure circuit using a check valve which prevents flow of high pressure fluid back into the low pressure supply circuit, thereby allowing the formation of a hydraulic link in the high pressure circuit.

Various problems are known in conventional compression braking system. First, a time delay may occur between the actuation of the three-way solenoid valve and the onset of the braking mode. This time delay is due in part to the positioning of the solenoid valve a spaced distance from the control valve, which creates longer than ideal fluid passages and thus delayed response time. The high pressure circuit may also comprise long fluid passages between the master and slave pistons, which disadvantageously increase the compressed fluid volume and thus the response time.

In addition, in conventional compression braking systems, the braking system is a bolt-on accessory that fits above the overhead. In such systems, in order to provide space for mounting the braking system, a spacer is positioned between the cylinder head and the valve cover. The valve cover is bolted to the spacer, which adds unnecessary height, weight, and costs to the engine. Many of the above-noted problems result from viewing the braking system as an accessory to the engine rather than as part of the engine itself.

One possible solution is to integrate components of the braking system with the rest of the engine components. One attempt at integrating parts of the compression braking system is found in U.S. Pat. No. 3,367,312 to Jonsson, which discloses an engine braking system including a rocker arm having a plunger, or slave piston, positioned in a cylinder integrally formed in one end of the rocker arm. The plunger may be locked in an outer position by hydraulic pressure in order to permit braking system operation. Jonsson also discloses a spring for biasing the plunger outward from the cylinder into continuous contact with the exhaust valve to permit the cam-actuated rocker lever to operate the exhaust valve in both the power and braking modes.

In addition, a control valve is used to control the flow of pressurized fluid to the rocker arm cylinder so as to permit selective switching between braking operation and normal power operation. The control valve unit is positioned separately from the rocker arm assembly, however, which results in unnecessarily long fluid delivery passages and therefore a longer response time. This may also lead to an unnecessarily large amount of oil that must be compressed before activation of the braking system can occur, resulting in less control over the timing of the compression braking.

Jonsson also discloses using the control valve to control the flow of fluid to a predetermined set of cylinders in the engine, thereby undesirably preventing individual engine cylinders or different groups of engine cylinders from being selectively operated in the braking mode.

Furthermore, the control valve as disclosed by Jonsson is a manually-operated, rotary type valve requiring actuation by the driver. Manual operation often results in unreliable and inefficient braking operation. Also, rotary valves are subject to undesirable fluid leakage between the rotary valve member and its associated cylindrical bore.

Other designs known in the art include U.S. Pat. No. 3,332,405 to Haviland, assigned to the assignee of the present application and incorporated herein by reference. Haviland discloses a compression braking system with a control valve unit for enabling the formation of a hydraulic link. The control valve unit is mounted in a cavity formed in a rocker arm that operates the exhaust valves during the braking mode. Separate cam lobes are used for normal power operation and braking operation. However, a single rocker arm is used to actuate the exhaust valves during both normal and braking modes. A drawback in this design is that the braking cam lobe profile design, and therefore the braking system operation, may be at least partially dependent on, or influenced by, the design of the cam lobe used for operating the exhaust valve during normal engine operation.

Another known design is disclosed in U.S. Pat. No. 4,251,051 to Quenneville, assigned to the assignee of the present application and incorporated herein by reference. Quenneville discloses a solenoid valve assembly with an inlet communicating with a supply of fluid, and one or more outlet passages communicating with respective loads requiring intermittent fluid supply and a drain passage. A respective ball valve is positioned between the inlet and each outlet and is spring-biased to block flow between the supply and outlet passage while opening the drain passage. An armature and pin are actuated to move the ball valve so as to connect the supply to the outlet and close the drain passage. However, while the valve assembly in the actuated position permits supply flow to the outlet passage, it does not prevent the return flow of fluid from the outlet passage into the supply passage and therefore does not permit the formation of a hydraulic link between different pressurized circuits as required by a control valve during compression braking system operation.

Designs in the known art have required independent check and shuttle valves in order to control a lost motion integrated rocker brake. Accordingly, there is a need for a simplified rocker brake control valve assembly. The design of the present invention integrates the check and shuttle valves into a single unit. This single unit serves to control the flow of oil within the integrated lost motion rocker brake. In addition, there have been many attempts to design systems to clip or reset lost motion circuits. The present invention also provides a system and method to allow the clipping or resetting of a lost motion engine brake system.

The present invention meets these needs and provides other benefits as well.

OBJECT OF THE INVENTION

It is therefore an object of the present invention to provide an economical control valve for an integrated lost motion rocker brake.

It is another object of the present invention to provide a simplified means of controlling the flow of hydraulic fluid in an integrated lost motion rocker brake.

It is still another object of the present invention to provide an improved means of switching an engine brake between positive power and braking.

It is yet another object of the present invention to provide control of an integrated lost motion rocker brake without using an independent check valve and shuttle valve.

It is a further object of the present invention to provide an integrated lost motion rocker brake with a single valve having the same function as a known check valve and shuttle valve.

It is still a further object of the present invention to provide a control valve with a shuttle valve that indexes to direct the flow of hydraulic fluid in an integrated lost motion rocker brake.

It is yet a further object of the present invention to provide a control valve that permits a constant directional (checked) flow of hydraulic fluid for automatic lash adjustment in an integrated lost motion rocker brake.

It is another object of the present invention to provide an integrated lost motion rocker brake with a control valve that allows check hydraulic fluid to fill behind the accumulator, thereby preventing the accumulator from indexing.

It is still another object of the present invention to provide a control valve for clipping or resetting an engine valve in a lost motion system.

It is yet another object of the present invention to provide means of clipping or resetting an engine valve in a lost motion system and thereby to prevent the need for piston pockets.

It is another object of the present invention to provide an indexed or rotated valve located in the rocker arm or shaft of an integrated lost motion rocker brake.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicant has developed an innovative and economical design for a single control valve for a lost motion integrated rocker brake. As illustrated in the accompanying drawings and disclosed in the accompanying claims, the invention is a braking system for an internal combustion engine having an engine valve selectively openable in response to movement of a rotary cam about a cam shaft and a rocker assembly cooperative therewith, and having a control valve hydraulically connected to an engine valve assembly and thereby to the engine valve, wherein the engine is operable in either a power mode or a braking mode, having an improvement comprising means for checking hydraulic fluid to provide constant directional flow of hydraulic fluid for automatic lash adjustment of a valve actuating piston having an upper end and a lower end; and means for controlling a supply of hydraulic fluid in order to provide actuation of the engine valve by the piston.

In an embodiment of the braking system of the present invention, the engine valve assembly may further comprise an accumulator slidably disposed in an accumulator bore in the upper end of the piston, the accumulator being biased upward by an accumulator spring, having a swivel foot disposed on a valve stem of the engine valve, and wherein the lower end of the piston is in contact with the swivel foot. The braking system of the present invention may combine the hydraulic fluid checking means and the controlling means together in the control valve.

The control valve may further comprise a control valve body having an upper end and a lower end and being slidably disposed in a control valve bore in the rocker arm and biased upward by a control valve spring, an inner body having a ball seat formed therein, and a check ball disposed in the inner body and biased upward by a check spring.

The control valve body may further comprise an upper annulus located toward the upper end of the control valve body, a lower annulus located toward the lower end of the control valve body, a middle annulus located around the control valve body between the upper annulus and the lower annulus, a first horizontal bore which diametrically spans the control valve body, having each end of the first horizontal bore opening within the upper annulus, and a second horizontal bore, which diametrically spans the control valve body, having each end of the second horizontal bore opening within the middle annulus, and wherein a first vertical bore and a second vertical bore are axially disposed in the inner body about a longitudinal axis.

In the braking system of the present invention, the check ball may be disposed in the second vertical bore, and the first vertical bore may connect the first horizontal bore with the second horizontal bore to provide hydraulic communication from the upper annulus, through the control valve body, to the middle annulus.

The braking system may further comprise a hydraulic system having a switched low pressure supply circuit and a constant low pressure supply circuit connected to the hydraulic fluid supply and to the control valve, and a lashless fluid supply circuit and an accumulator control circuit connecting the control valve to the engine valve assembly. Upon activation of a solenoid switch in braking mode, the control valve may index in the control valve bore, aligning the middle annulus with the lashless fluid supply circuit and the accumulator control circuit so that the lashless fluid supply circuit and the accumulator control circuit become hydraulically locked and the motion of the cam is translated directly into the motion of the engine valve.

In the braking system of the present invention, the hydraulic fluid controlling means may further comprise an accumulator control circuit and a switched low pressure supply circuit for providing clipping of the valve actuating piston and thereby provide lost motion braking. The braking system may further comprise a clipping/reset spool disposed in the cam shaft, and the clipping/reset spool may further comprise a plurality of clipping annuluses described therearound.

In the braking system of the present invention, the plurality of clipping annuluses may each form a reduced diameter about only a portion of the clipping/reset spool, such that when the reduced diameter portion is aligned with a clip passageway and thereby with the accumulator control circuit, hydraulic fluid dumps into the supply of hydraulic fluid, and when a full outer diameter portion of the clipping/reset spool is aligned with the clip passageway and thereby with the accumulator control circuit, the accumulator control circuit is closed and hydraulically locked, and the rocker assembly follows a braking bump on the cam.

In addition, Applicant has developed an innovative and economical design for clipping or resetting of a lost motion engine brake system. As embodied herein, the invention is a braking system for an internal combustion engine having an engine valve selectively openable in response to movement of a rotary cam about a cam shaft and a rocker assembly cooperative therewith, and having a control valve hydraulically connected to an engine valve assembly and thereby to the engine valve, wherein the engine is operable in either a power mode or a braking mode, and the improvement comprising a clipping/reset spool disposed in the cam shaft and connected to an accumulator control circuit, wherein movement of the clipping/reset spool provides clipping of a valve actuating piston and thereby lost motion braking, and wherein the clipping/reset spool further comprises a plurality of clipping annuluses described therearound, the plurality of clipping annuluses each forming a reduced diameter about only a portion of the clipping/reset spool, such that when the reduced diameter portion is aligned with a clip passageway and thereby with the accumulator control circuit, hydraulic fluid dumps into the supply of hydraulic fluid, and when a full outer diameter portion of the clipping/reset spool is aligned with the clip passageway and thereby with the accumulator control circuit, the accumulator control circuit is closed and hydraulically locked, and the rocker assembly follows a braking bump on the cam.

In the clipping/reset braking system, the accumulator control circuit may further comprise a check valve biased by a check valve spring, wherein the check valve checks a supply of hydraulic fluid in the accumulator control circuit.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

BRIEF DESCRIPTION OF THE DRAWINGS

The invention will now be described in conjunction with the following drawings in which like reference numerals designate like elements and wherein.

DETAILED DESCRIPTION OF THE PREFERRED EMBODIMENTS

Reference will now be made in detail to preferred embodiments of the present invention, examples of which are illustrated in the accompanying drawings.

Figure 1:
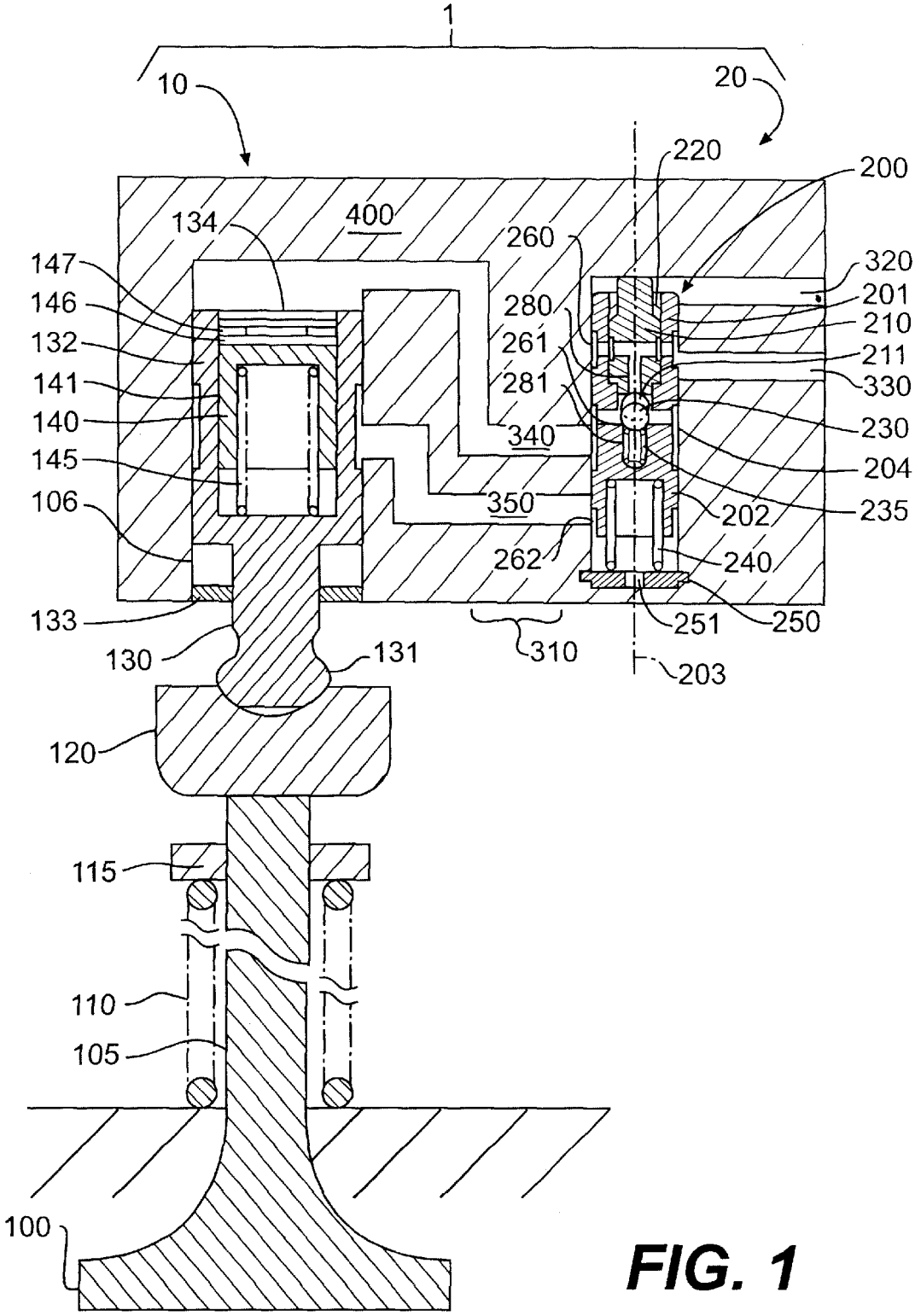
FIG. 1 depicts a cross section in elevation of a rocker brake valve actuation assembly according to the present invention.

A rocker brake valve actuation assembly according to the present invention is shown in FIG. 1 as 1. Valve actuation assembly 1 comprises control value 20 according to the present invention and engine valve assembly 10 from the known art. Control value 20 is housed in rocker arm 400 (not shown) and is hydraulically connected to engine valve assembly 10.

As shown in FIG. 1, known engine valve assembly 10 comprises engine valve 100, which further comprises upper portion or engine valve stem 105, engine valve spring 110, spring retainer 115, and swivel foot 120. Engine valve spring 110 is held in place by spring retainer 115 which biases engine valve 100 upwards, that is, in a closed position. Engine valve assembly 10 further comprises piston bore 106, which is disposed in rocker arm 400 (not shown) and piston 130, which is slidably disposed in piston bore 106. Piston 130 further comprises lower end 131 and upper end 132, and is held in place in piston bore 106 during assembly by piston retaining ring 133. Lower end 131 of piston 130 is shaped to seat in swivel foot 120. Top end face 134 forms the top surface of upper end 132 of piston 130.

Engine valve assembly 10 further comprises accumulator 140, which is slidably disposed within accumulator bore 141 in upper end 132 of piston 130, and accumulator spring 145, which biases accumulator 140 toward washer 146. Washer 146 is held in place by accumulator retaining ring 147. Washer 146, accumulator retaining ring 147, accumulator 140, and accumulator bore 141 together proscribe the indexing distance of accumulator 140.

As embodied herein, control value 20 is hydraulically connected to piston bore 106. Control valve bore 204 is preferably disposed in rocker arm 400 (not shown). Control valve 20 comprises control valve body 200, which has an upper end 201 and a lower end 202. Control valve body 200 is slidably disposed in control valve bore 204 about longitudinal axis 203 and indexes to direct the flow of hydraulic fluid in the system. Control valve body 200 limits the travel of control value 20 by aligning flow paths for the hydraulic fluid, and thereby provides the lower stop for control value 20.

Continuing with reference to FIG. 1, control valve body 200 further comprises inner body 210. Inner body 210 is secured within control valve body 200 by ductile locking ring 220. Inner body 210 further comprises ball seat 211. Check ball 230 is disposed in inner body 210 and is biased upward into ball seat 211 by check spring 235. Check ball 230 provides the hydraulic fluid checking function. Inner body 210 routs the flow of a constant hydraulic fluid supply to check ball 230, and provides an upper stop that allows indexing hydraulic fluid to apply pressure to the top surface of control valve body 200.

According to the present invention, control valve body 200 further comprises control valve spring 240, which biases control valve body 200 upward, and ductile lock washer 250, which locks control valve body 200 in control valve bore 204. Control valve spring 240 prevents movement of control value 20 unless adequate hydraulic fluid pressure is provided at the top of control valve body 200. After the indexing hydraulic fluid supply is turned off, control valve spring 240 returns control valve body 200 to its initial, biased upward position. Ductile lock washer 250 provides a simple means to lock the assembly of control valve body 200 in control valve bore 204, and provides a solid stop to limit the travel of control valve body 200 . Ductile lock washer 250 further comprises washer bore 251, through which hydraulic fluid may flow to atmosphere.

Continuing with reference to control value 20, control valve body 200 further comprises three annuluses having a diameter less than that of control valve body 200: upper annulus 260 which is located toward upper end 201, lower annulus 262 which is located toward lower end 202, and middle annulus 261 therebetween. Control valve body 200 further comprises first horizontal bore 270, which diametrically spans control valve body 200, having each end of first horizontal bore 270 opening within upper annulus 260, and second horizontal bore 271, which diametrically spans control valve body 200, having each end of second horizontal bore 271 opening within middle annulus 261. First vertical bore 280 and second vertical bore 281 are axially disposed in inner body 210 about longitudinal axis 203. As embodied herein, first vertical bore 280 communicates with first horizontal bore 270 and second horizontal bore 271 to provide communication between upper annulus 260 and middle annulus 261. Second vertical bore 281 houses check spring 235.

Valve actuation assembly 1 further comprises of four hydraulic circuits. Two circuits, collectively 300, enter control value 20: switched low pressure supply circuit 320, which preferably contains hydraulic fluid at about 50 psi, and constant low pressure supply circuit 330, which also preferably contains hydraulic fluid at about 50 psi. Switched low-pressure supply circuit 320 connects the hydraulic fluid supply to control valve bore 204 at control valve body upper end 201. Constant low pressure supply circuit 330 connects the hydraulic fluid supply through upper annulus 260 and first horizontal bore 270 into inner body 210, past check ball 230 and through middle annulus 261 into lashless fluid supply circuit 340.

As embodied herein, two additional hydraulic circuits, collectively 310, exit control value 20: lashless fluid supply circuit 340 and accumulator control circuit 350. Lashless fluid supply circuit 340 connects piston bore 106 at piston upper end 132 to control valve bore 204 above accumulator control circuit 350. Lashless fluid supply circuit 340 biases piston 130 down so that it is always in contact with swivel foot 120, providing lashless operation. Accumulator control circuit 350 connects control valve body lower end 202 to accumulator 140.

As contemplated by the present invention, control value 20 provides an efficient means to switch between positive power and braking in an integrated lost motion rocker brake. Control value 20 is preferably located within a rocker arm or shaft, however, the system of the present invention could also be contained in any device where a lost motion system is needed.

Figure 2:
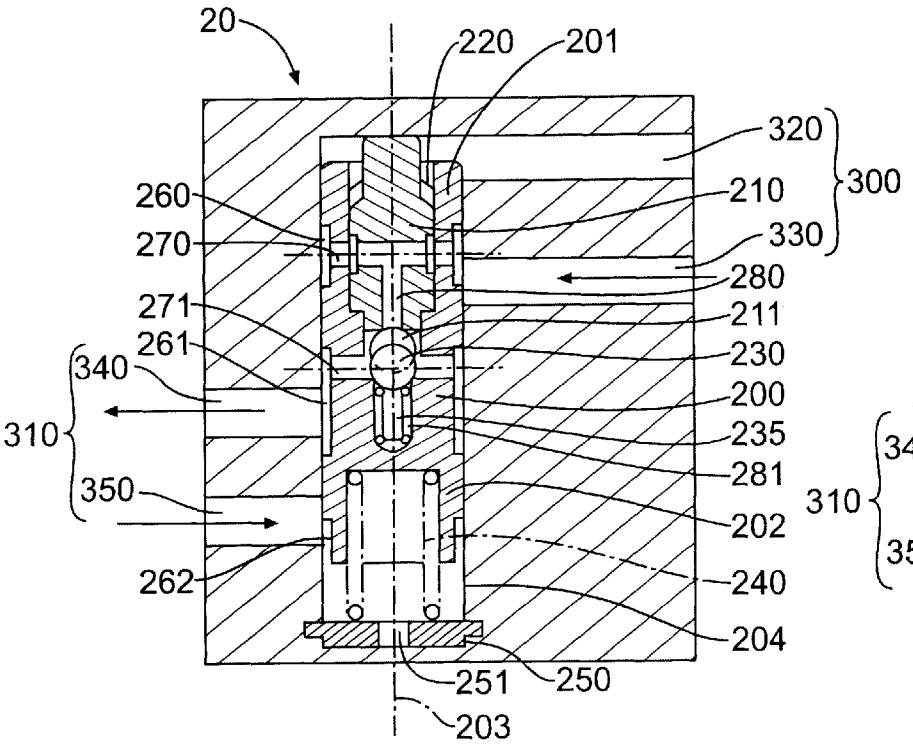
FIG. 2 depicts a cross section in elevation of a control valve for a rocker brake valve actuation assembly during positive power operation according to the present invention.

Referring now to FIG. 2, control value 20 is shown during positive power mode of engine operation. The rocker brake valve actuation assembly 1 of FIG. 1 operates as follows: a solenoid switch (not shown) is off. Low pressure hydraulic fluid is present in hydraulic circuit 300, in both switched low pressure supply circuit 320 and constant low pressure supply circuit 330. Control value 20 is biased upward by control valve spring 240 because the low pressure hydraulic fluid from switched low pressure supply circuit 320 transmits less force than that from control valve spring 240. With control value 20 in this position, upper annulus 260 is aligned with constant low pressure supply circuit 330, middle annulus 261 is aligned with lashless fluid supply circuit 340, and lower annulus 262 is aligned with accumulator supply circuit 350. Lower annulus 262 vents to the main hydraulic fluid supply.

As a result, low pressure hydraulic fluid forms a continuous circuit from constant low pressure supply circuit 330 to the lashless fluid supply circuit 340. The flow path is as follows: from the switched low pressure supply circuit 320, through first horizontal bore 270, first vertical bore 280 in inner body 210, past check ball 230, through second horizontal bore 271, through middle annulus 261 and into the lashless fluid supply circuit 340.

During operation, check ball 230 is seated in ball seat 211 when the force on the lower portion of check ball 230 is greater than the force on the top of the ball. The force acting on the lower portion of check ball 230 is provided by the hydraulic pressure of lashless fluid supply circuit 340 and check spring 235. The force acting on the upper portion of check ball 230 is due to the hydraulic pressure of constant low pressure supply circuit 330. During positive power operation, when rocker arm 400 is rotated off the base circle of the cam lobe (not shown), check ball 230 is biased upward by check spring 235, because the low pressure hydraulic fluid from constant low pressure supply circuit 330 transmits less force than that from check spring 235. When rocker arm 400 (not shown) is on the base circle of the cam lobe, the pressure of the lashless fluid supply circuit 340 is less than the pressure of the constant low pressure supply circuit 330, thus allowing lashless fluid supply circuit 340 to fill or refill if necessary. This provides checking, that is, a constant directional flow of the hydraulic fluid, and provides automatic lash adjustment.

Figure 4A:
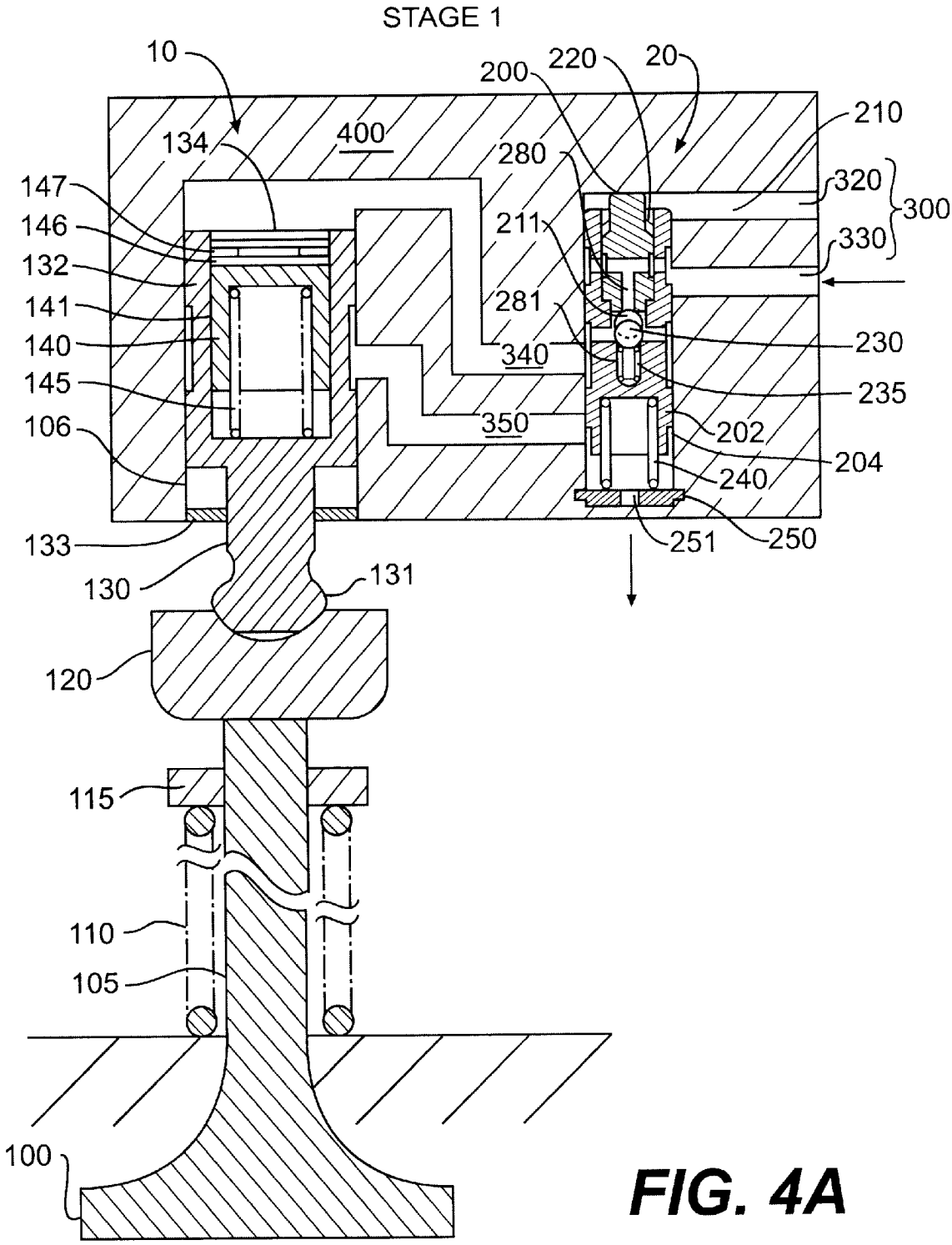
FIG. 4*a* depicts a cross section in elevation of a rocker brake valve actuation assembly according to the present invention during Stage 1 of positive power operation.

Referring now to FIG. 4*a*, engine valve assembly 10 operates during Stage 1 of positive power mode as follows: piston 130 is in a lowered position. Lower end of piston 131 is maintained in contact with swivel foot 120 and the engine valve stem 105 by means of the hydraulic pressure from lashless fluid supply circuit 340, and engine valve 100 is closed. Accumulator 140 is biased upward by accumulator spring 145. In this position, hydraulic fluid that has accumulated behind accumulator 140 may flow to atmosphere through washer bore 251 in ductile lock washer 250 as the accumulator indexes. This allows rocker arm 400 (not shown) to follow the normal cam profile, and permits the auxiliary cam profile (braking bump 411, not shown) to be absorbed by the accumulator, resulting in normal exhaust valve motion.

Figure 4B:
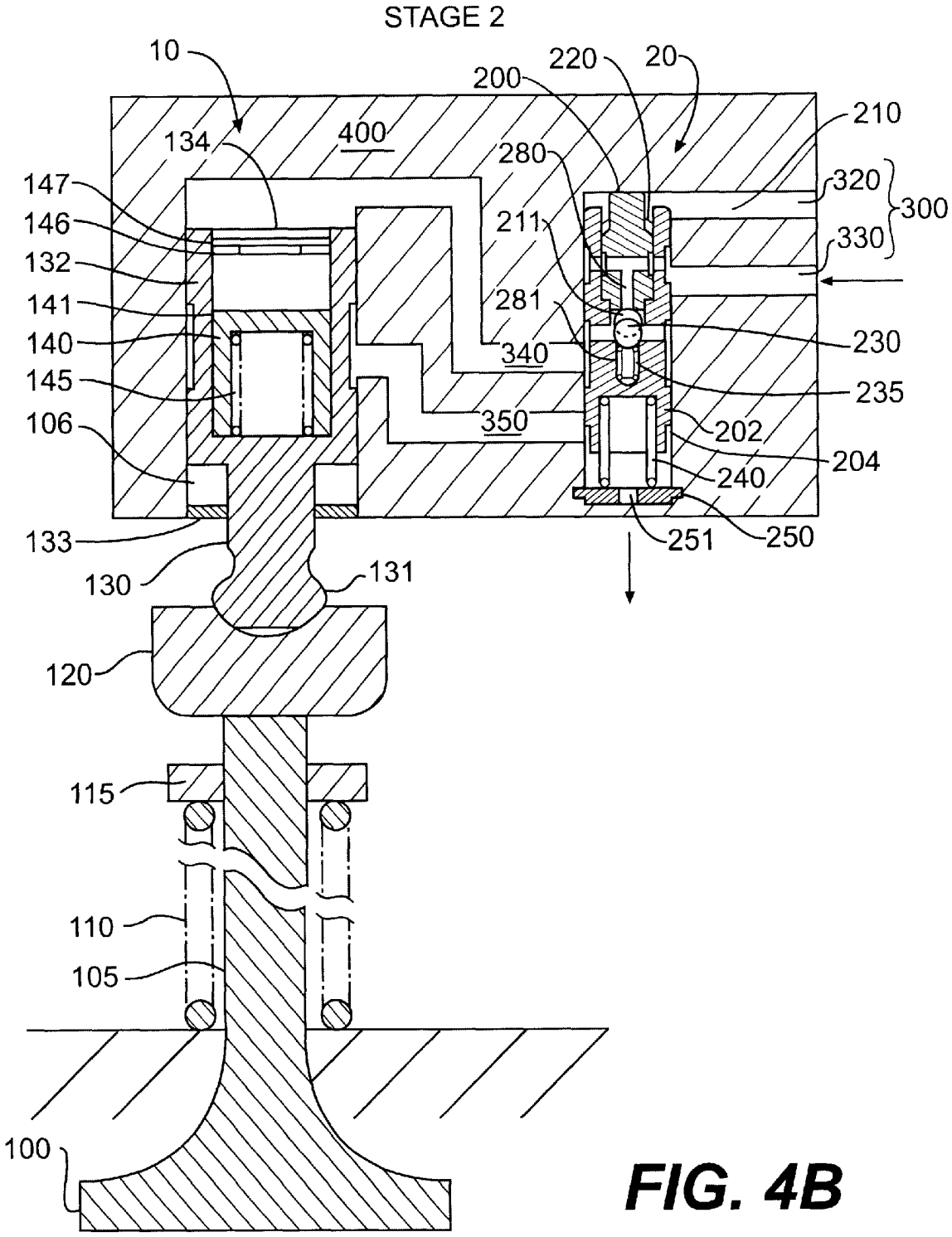
FIG. 4*b* depicts a cross section in elevation of a rocker brake valve actuation assembly according to the present invention during Stage 2 of positive power operation.

Stage 2 of positive power operation is shown in FIG. 4*b*. Hydraulic fluid that has accumulated behind accumulator 140 has flowed to atmosphere via accumulator supply circuit 350, lower annulus 262 and washer bore 251, and accumulator 140 is fully indexed. Piston 130 moves upward to absorb the braking portion of the lost motion cam lobe profile (not shown). The net result is that rocker arm 400 (not shown) only follows the exhaust profile of the cam lobe profile.

Figure 3:
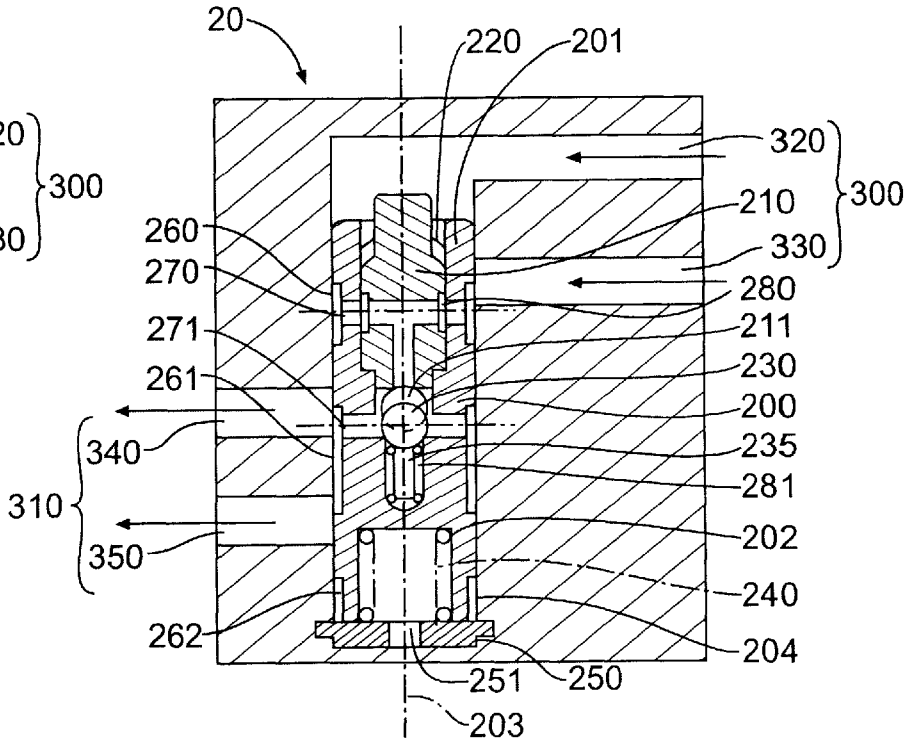
FIG. 3 depicts a cross section in elevation of control valve for a rocker brake valve actuation assembly during braking operation according to the present invention.

Referring now to FIG. 3, control value 20 is shown during braking mode of engine operation. A solenoid switch (not shown) is turned on. Hydraulic fluid flows through switched low pressure supply circuit 320 into control valve bore 204, and as the pressure of the hydraulic fluid becomes greater than the upward force of control valve spring 240, control valve body 200 begins to index or move downward. A minimum hydraulic fluid pressure is required to index control valve body 200. The required pressure is determined by the size of control valve spring 240 and the wetted surface area of the control valve body 200.

Check ball 230 is biased upward by check spring 235, because the low pressure hydraulic fluid from constant low pressure supply circuit 320 transmits less force than that from check spring 235. This provides checking, that is, a constant directional flow of the hydraulic fluid, and provides automatic lash adjustment during braking operation. Check ball 230 is checked when rocker arm 400 is on an elevated section of the cam lobe (not shown). When rocker arm 400 is on the base circle of the cam lobe, the circuit is allowed to fill or make up hydraulic fluid lost to leakage.

Figure 5:
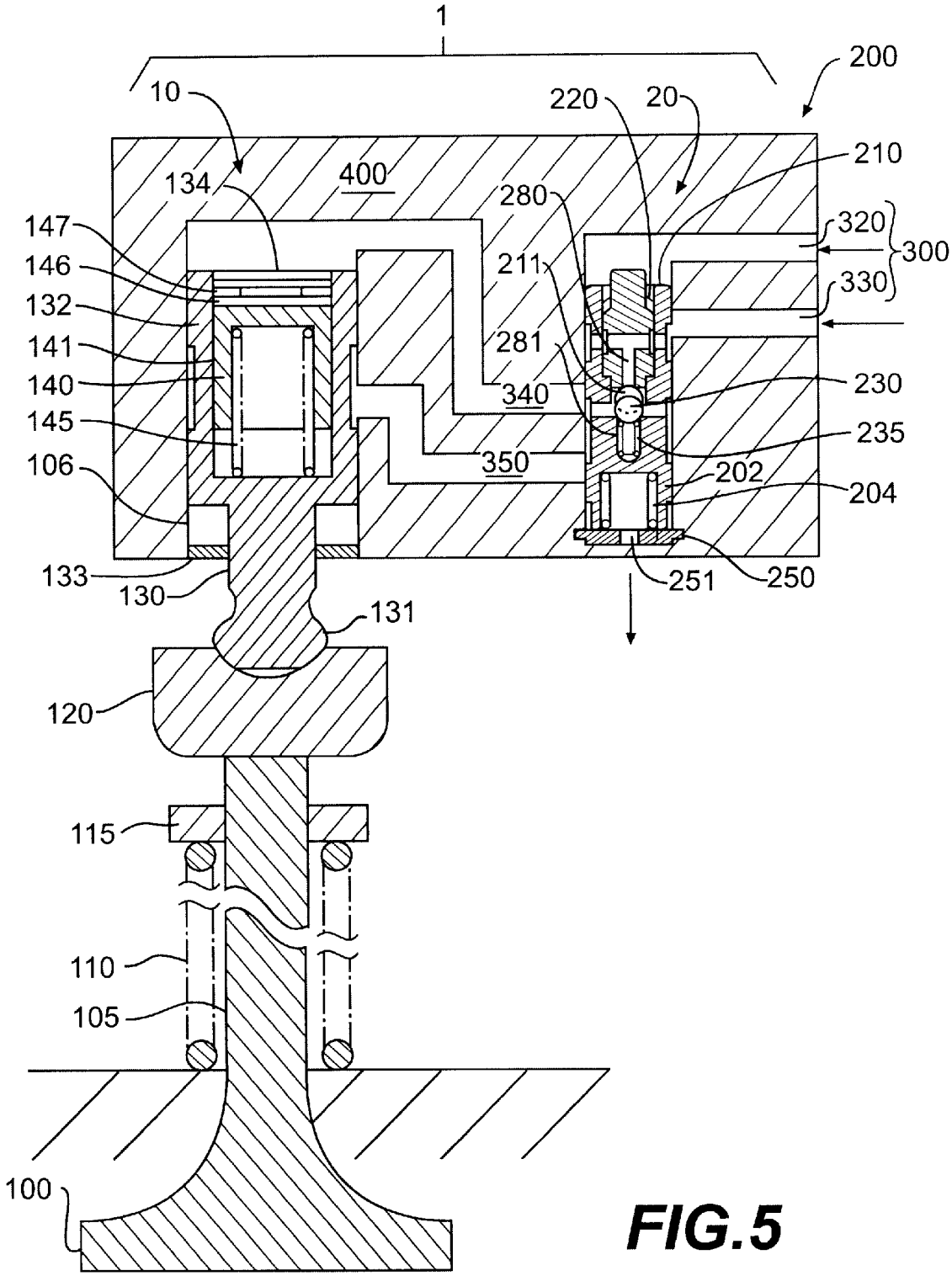
FIG. 5 depicts a cross section in elevation of a rocker brake valve actuation assembly according to the present invention during braking operation.

When control value 20 is fully indexed, as shown in FIGS. 3 and 5, upper annulus 260 is aligned with constant low pressure supply circuit 330, middle annulus 261 is aligned with both lashless fluid supply circuit 340 and accumulator control circuit 350, and hydraulic fluid flows from both circuits 340 and 350 in engine valve assembly 10. This allows checked hydraulic fluid to fill behind accumulator 140, preventing the accumulator from indexing. When rocker arm 400 (not shown) rotates in response to the motion of a rotating cam 410 (not shown), lashless fluid supply circuit 340 and accumulator control circuit 350 become pressurized. When circuits 340 and 350 are hydraulically locked, the motion of cam 410 is translated directly into the motion of engine valve 100. The rocker arm 400 (not shown) must follow the auxiliary cam profile (braking bump 411) and transmit this motion to engine valve 100. In this position, the additional motion causes engine valve 100 to lift greater than experienced under positive power. This may require substantial valve-to-piston clearance or the presence of piston pockets. Providing a clipping function (as described below) may eliminate the need for piston pockets.

Referring now to FIG. 5, engine valve assembly 10 operates during braking mode as follows: hydraulic fluid from lashless fluid supply circuit 340 enters piston bore 106 at upper end of piston 132 and biases piston 130 downward. The motion of piston 130 is linearized through swivel foot 120 when contact is made with upper end of the valve stem 105, and the downward force compresses engine valve spring 110, opening engine valve 100, which results in a compression release braking event.

Figure 6B:
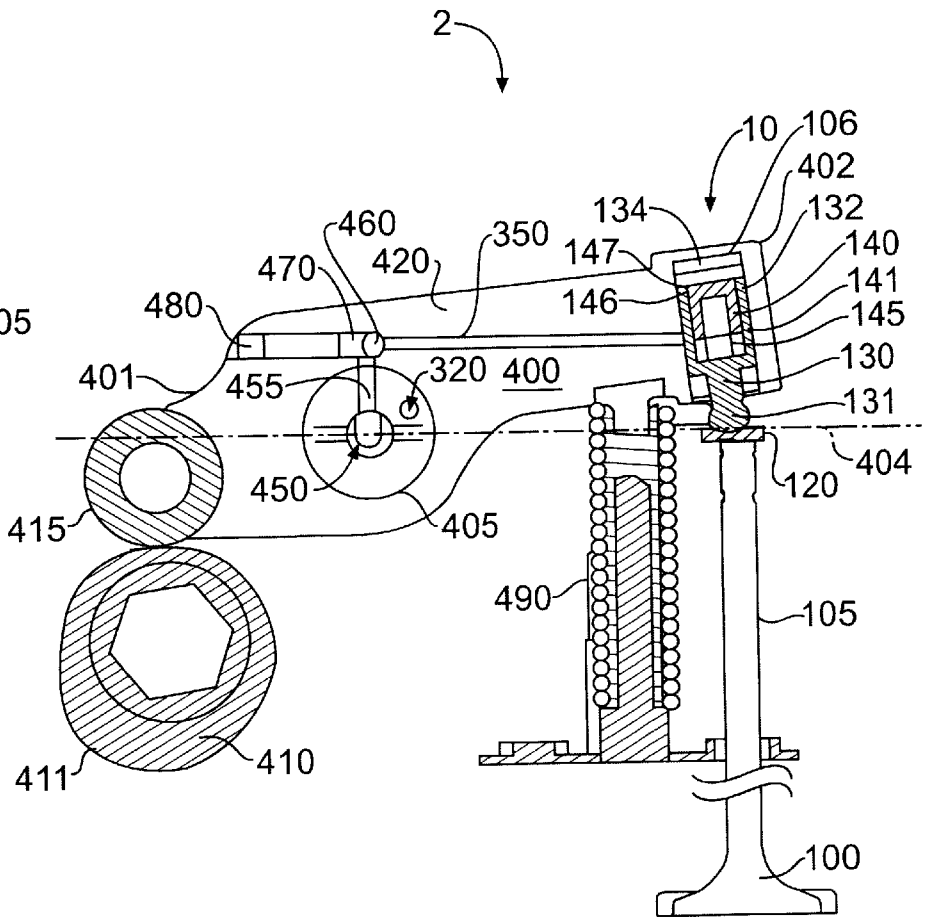
FIG. 6*b* depicts a cross section in elevation of the rotationally driven, ported rocker arm and valve system for clipping/reset of a lost motion circuit of FIG. 6*a*, rotated 90° about a vertical axis.
Figure 6A:
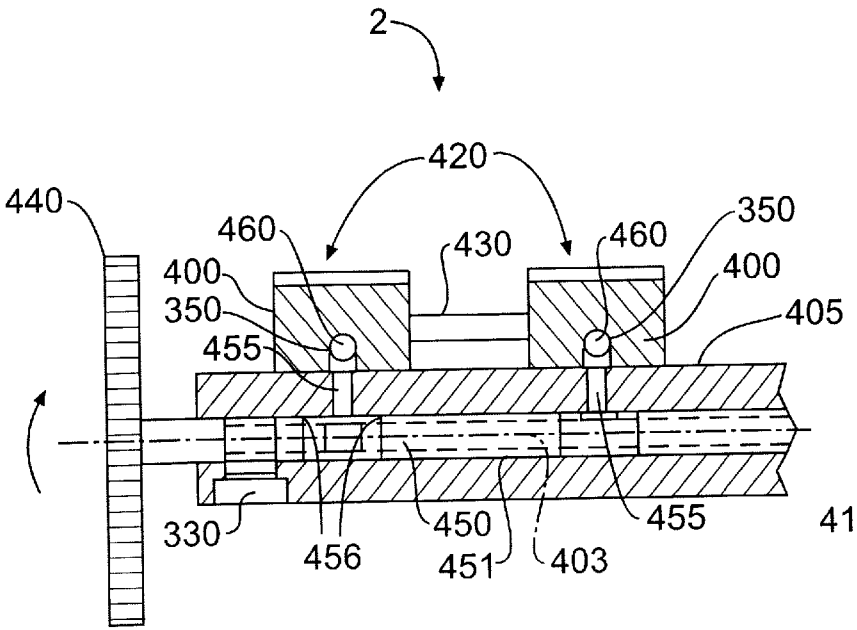
FIG. 6*a* depicts a cross section in elevation of a rotationally driven, ported rocker arm and valve system for clipping/reset of a lost motion circuit according to an alternate embodiment of the present invention.

Referring now to FIGS. 6*a* and 6*b*, an alternate embodiment of the present invention is shown as rotationally-driven lost motion rocker brake assembly 2. FIG. 6*b* depicts the rotationally-driven lost motion rocker brake assembly of FIG. 6*a*, rotated 90° about a vertical axis. As embodied herein, rotationally-driven lost motion rocker brake assembly 2 comprises rocker arm 400, having a first end 401 and a second end 402, cam 410, spring 490 and control valve 21 (not shown). First end of rocker arm 401 further comprises cam roller follower 415.

Control valve 21 (not shown) comprises only the shuttle valve features of control value 20 described in connection with FIGS. 1–5 above, that is, control valve body 200 having an upper end 201 and a lower end 202, and slidably disposed in control valve bore 204 about longitudinal axis 203, control valve spring 240, which biases control valve body 200 upward, and ductile lock washer 250, which locks control valve body 200 in control valve bore 204. As in control value 20, control valve spring 240 prevents movement of control valve 21 unless adequate hydraulic fluid pressure is provided at the top of control valve body 200. After the indexing hydraulic fluid supply is turned off, control valve spring 240 returns control valve body 200 to its initial, biased upward position. Ductile lock washer 250 provides a simple means to lock the assembly of control valve body 200 in control valve bore 204, and provides a solid stop to limit the travel of control valve body 200. Ductile lock washer 250 further comprises washer bore 251, through which hydraulic fluid may flow to atmosphere.

As embodied herein, rotationally-driven lost motion rocker brake assembly 2 further comprises engine valve 10 as described in connection with FIGS. 1–5 above. Engine valve 10 comprises piston bore 106, which is disposed in rocker arm 400 and piston 130, which is slidably disposed in piston bore 106. Piston 130 further comprises lower end 131 and upper end 132, and is held in place in piston bore 106 during assembly by piston retaining ring 133. Lower end 131 of piston 130 is shaped to seat in swivel foot 120. Top end face 134 forms the top surface of upper end 132 of piston 130.

With continuing reference to FIGS. 6*a* and 6*b*, engine valve assembly 10 further comprises accumulator 140, which is slidably disposed within accumulator bore 141 in upper end 132 of piston 130, and accumulator spring 145, which biases accumulator 140 toward washer 146. Washer 146 is held in place by accumulator retaining ring 147. Washer 146, accumulator retaining ring 147, accumulator 140, and accumulator bore 141 together proscribe the indexing distance of accumulator 140. piston bore 106, piston 130, accumulator bore 141, and accumulator 140 are housed in second end of rocker arm 402.

As embodied herein, engine valve assembly 10 further comprises engine valve 100, having engine valve stem 105 and swivel foot 120, which is disposed on upper end of engine valve stem 105. As described above in connection with FIGS. 1–5, lower end 131 of piston 130 is seated on swivel foot 120.

As embodied herein, rocker arm 400 rotates about rocker shaft 405 in response to rotation of cam 410, which urges cam roller follower 415 upward. Spring 490 is provided to counter inertial effects of the rotating rocker arm 400. Rocker arm 400 further comprises lost motion rocker assembly 420. Lost motion rocker assembly 420 comprises accumulator control circuit 350 disposed therein, and clipping/reset passageway 455 connected thereto.

Rocker shaft 405 further comprises switched low pressure supply circuit 320, which is connected to piston bore 106 (passageway is not shown), and rocker shaft bore 406 with clipping/reset spool 450 slidably disposed therein. Clipping/reset spool 450 may be connected to gear 440, or may be given rotation though a different auxiliary source. Gear 440 is connected to a source of rotational motion (not shown) in the engine. Clipping/reset spool 450 further comprises a plurality of clipping annuluses 451. Each clipping annulus 451 comprises a reduced diameter around a portion of clipping/reset spool 450. A portion of each clipping annulus 451 has the same outer diameter as clipping/reset spool 450. It is this full diameter portion of each clipping/reset annulus that closes off flow hydraulic fluid to clipping/reset passageway 455. When clipping/reset passageway 455 is not closed, hydraulic fluid may dump to the main hydraulic fluid supply. When clipping/reset passageway 455 is closed, the circuit is hydraulically locked and rocker arm 400 is allowed to follow braking bump 411.

Clipping/reset passageway 455 connects clipping/reset spool 450 to accumulator control circuit 350. In the alternate embodiment of FIGS. 6*a* and 6*b*, accumulator control circuit 350 further comprises check valve 460, which is biases toward accumulator 140 by check spring 470. Pipe plug 480 seals accumulator control circuit 350 at first end of rocker arm 401.

It is to be understood that although two lost motion rocker assemblies 420 are shown in FIG. 6*a*, the present invention contemplates that a lost motion rocker assembly is present for each cylinder of the engine. Thus for a standard six-cylinder engine, the present invention would comprise six lost motion rocker assemblies, each connected to the next by intake rocker 430.

With continuing reference to FIGS. 6*a* and 6*b*, rotationally-driven lost motion rocker brake assembly 2 operates as follows in braking mode: in response to a source of rotational motion (not shown) in the engine, gear 440 rotates and turns clipping/reset spool 450 about first horizontal axis 403. A solenoid switch is turned on by the operator to supply hydraulic fluid which rotates or indexes control valve 21 (not shown). Control valve 21 rotates, opening and closing the port. When the port is open, hydraulic fluid exhausts, and when it is closed, the fluid is hydraulically locked. Each lost motion exhaust rocker assembly 420 has its own separate on/off port control. This allows hydraulic fluid to evacuate from rocker brake assembly 2, which in turn permits engine valve 100 to clip or reset.

As contemplated by the present invention, when rocker brake assembly 2 is in braking mode, control valve 21 is fully indexed and is blocked from exhausting hydraulic fluid to atmosphere. The presence of accumulator control circuit 350 allows accumulator 140 to separately exhaust to atmosphere at a timed interval. The interval is timed so that piston 130 moves upward into rocker arm 400, absorbing the braking bump 411 on the profile of cam 410. This innovation allows the clipping or resetting of the engine valve in a lost motion system, thereby precluding the need for piston pockets.

Figure 7:
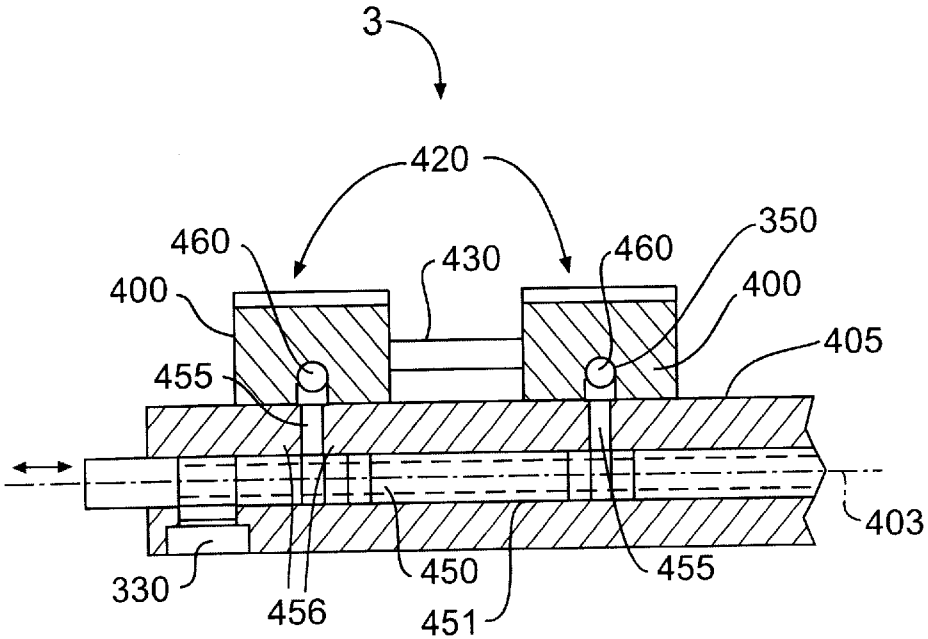
FIG. 7 depicts a cross section in elevation of a linear-activated, ported rocker arm and valve system according to an alternate embodiment of the present invention.

Referring now to FIG. 7, another alternate embodiment of the present invention is shown as linear-activated lost motion rocker brake assembly 3. This embodiment comprises the same features (see description above in connection with FIGS. 6*a* and 6*b*) as rotationally-driven lost motion rocker brake assembly 2, with the exception that gear 440 or other source of rotational motion is replaced by a source of linear activation (not shown) that urges clipping/reset spool 450 in a linear motion instead of a rotational motion. When the linear motion actuates clipping/reset spool 450 in, the plurality of clipping annuluses 451 line up and this causes hydraulic fluid to be evacuated from lost motion rocker brake assembly 3, allowing engine valve 100 to clip to reset. When the linear motion actuates clipping/reset spool 450 out, the plurality of clipping annuluses 451 do not line up and clipping does not occur. When in braking mode, spool annuluses 451 will index every cycle. During the cycle, the full diameter portion of each spool annulus 451 will cover the clipping/reset passageway 455 when accumulator 140 needs to be locked into place. Rocker arm 400 will follow the braking bump 411. Around-top dead-center, the linear or rotationally activated valve will move so that the hydraulic fluid that is trapped behind control value 20 will exhaust.

Figure 8:
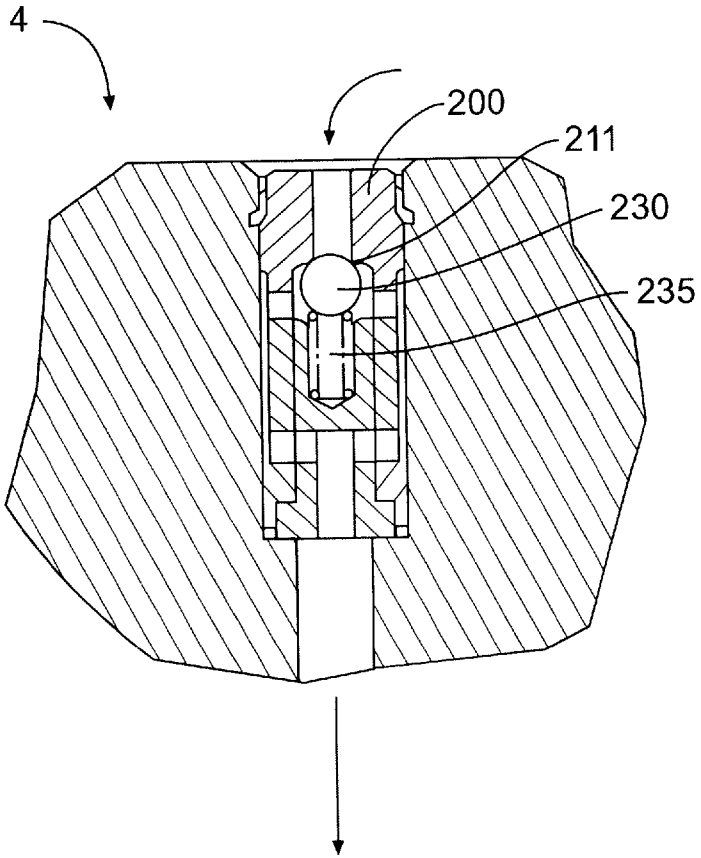
FIG. 8 depicts a cross section in elevation of a miniature axial flow check valve according to an alternate embodiment of the present invention.

Referring now to FIG. 8, another alternate embodiment of the present invention is shown as miniature axial flow check valve 4. Check valve 4 is contained within a bore and comprises check ball 230, which is disposed in control valve body 200 and is biased upward into ball seat 211 by check spring 235. Check ball 230 provides the hydraulic fluid checking function. Arrows show the flow of hydraulic fluid in the top and out the bottom of check valve 4.

Figure 10:
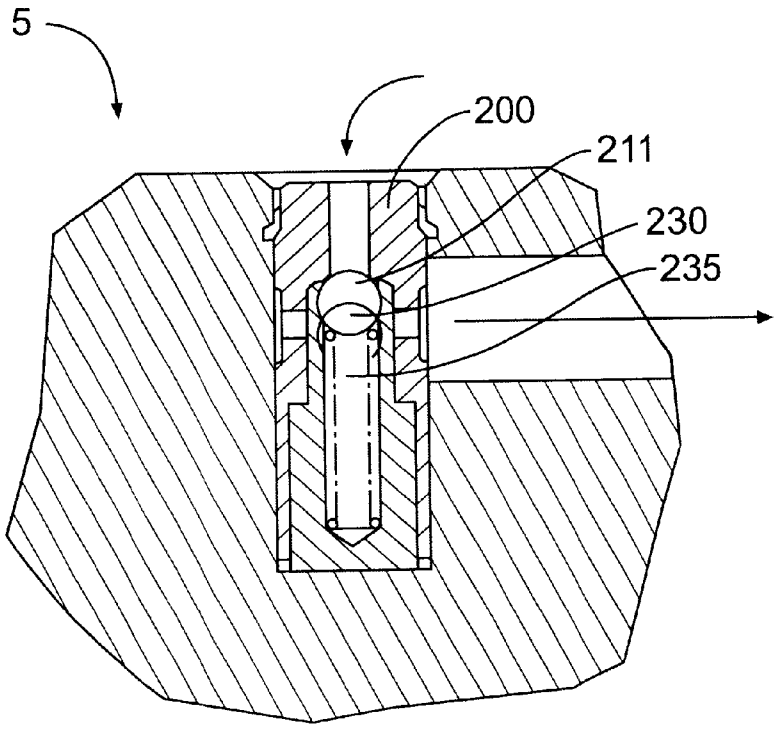
FIG. 10 depicts a cross section in elevation of a miniature radial flow check valve according to an alternate embodiment of the present invention utilizing a different assembly technique.
Figure 9:
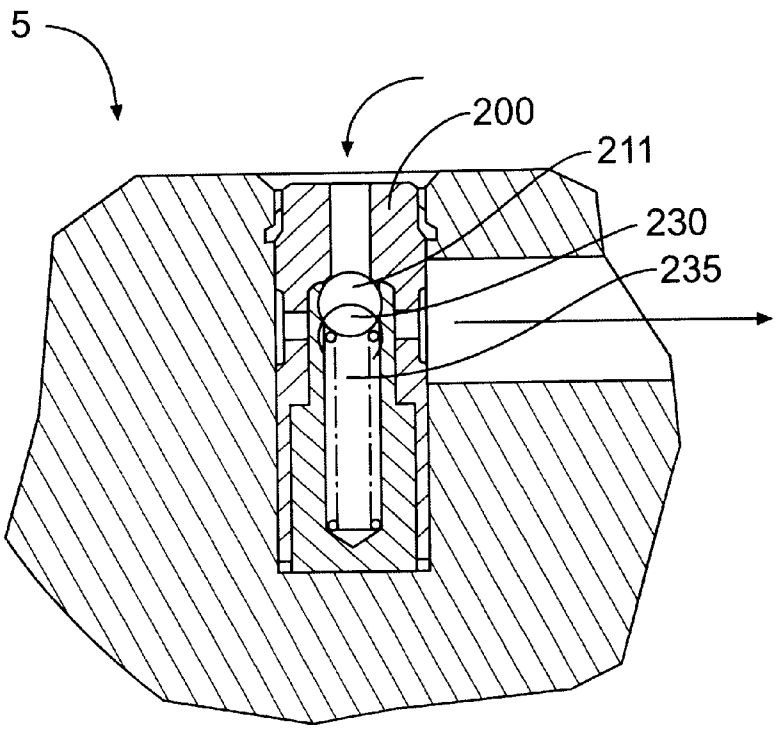
FIG. 9 depicts a cross section in elevation of a miniature radial flow check valve according to an alternate embodiment of the present invention.

Referring now to FIGS. 9 and 10, another alternate embodiment of the present invention is shown as miniature radial flow check valve 5. Check valve 5 is contained within a bore and comprises check ball 230, which is disposed in control valve body 200 and is biased upward into ball seat 211 by check spring 235. Check ball 230 provides the hydraulic fluid checking function. Arrows show the flow of hydraulic fluid in the top and out the side of check valve 5.

Check valves 4 and 5 may be used in valve actuation assembly 1, rotationally-driven lost motion rocker brake assembly 2, or linear-activated lost motion rocker brake assembly 3.

It will be apparent to those skilled in the art that various modifications and variations can be made in the construction, configuration, and/or operation of the present invention without departing from the scope or spirit of the invention. In the embodiments of control value 20 mentioned above, various changes may be made without departing from the scope and spirit of the invention. For example, ductile locking ring 220 provides an efficient way to lock the control valve assembly together, but it may be replaced by threading the parts together or through other assembly techniques. Ductile lock washer 250 is contemplated for use with a high speed assembly, but it may be replaced with a snap ring and washer or other locking device. Further, it may be appropriate to make additional modifications or changes to the individual components, including, but not limited to, the washers, rings, or other materials without departing from the scope of the invention.

In the embodiments of the clipping/reset system described herein, an indexing or rotating valve may be located in a ported rocker arm or shaft and used to open the port in the rocker arm or shaft, permitting hydraulic fluid to evacuate from the lost motion rocker, the allowing the valve to clip or reset.

Thus, it is intended that the present invention cover the modifications and variations of the invention provided they come within the scope of the appended claims and their equivalents.

What is claimed is:

1. In a braking system for an internal combustion engine having an engine valve selectively openable in response to movement of a rotary cam about a cam shaft and a rocker assembly cooperative therewith, and having a control valve hydraulically connected to an engine valve assembly and thereby to said engine valve, wherein said engine is operable in either a power mode or a braking mode, the improvement comprising:

means for checking hydraulic fluid to provide constant directional flow of hydraulic fluid for automatic lash adjustment of a valve actuating piston having an upper end and a lower end; and means for controlling a supply of hydraulic fluid in order to provide actuation of said engine valve by said piston.

2. The braking system of claim 1, wherein said engine valve assembly further comprises an accumulator slidably disposed in an accumulator bore in said upper end of said piston, said accumulator biased upward by an accumulator spring, having a swivel foot disposed on a valve stem of said engine valve, and wherein said lower end of said piston is in contact with said swivel foot.

3. The braking system of claim 2, wherein said hydraulic fluid checking means and said controlling means are combined in said control valve.

4. The braking system of claim 3, wherein said control valve further comprises a control valve body having an upper end and a lower end and being slidably disposed in a control valve bore in said rocker arm and biased upward by a control valve spring, an inner body having a ball seat formed therein, and a check ball disposed in said inner body and biased upward by a check spring.

5. The braking system of claim 4, wherein said control valve body further comprises an upper annulus located toward said upper end of said control valve body, a lower annulus located toward said lower end of said control valve body, a middle annulus located around said control valve body between said upper annulus and said lower annulus, a first horizontal bore which diametrically spans said control valve body, having each end of said first horizontal bore opening within said upper annulus, and a second horizontal bore, which diametrically spans said control valve body, having each end of said second horizontal bore opening within said middle annulus, and wherein a first vertical bore and a second vertical bore are axially disposed in said inner body about a longitudinal axis.

6. The braking system of claim 5, wherein said check ball is disposed in said second vertical bore, and wherein said first vertical bore connects said first horizontal bore with said second horizontal bore to provide hydraulic communication from said upper annulus, through said control valve body, to said middle annulus.

7. The braking system of claim 6 further comprising a hydraulic system having a switched low pressure supply circuit and a constant low pressure supply circuit connected to said hydraulic fluid supply and to said control valve, and a lashless fluid supply circuit and an accumulator control circuit connecting said control valve to said engine valve assembly.

8. The braking system of claim 7, wherein upon activation of a solenoid switch in braking mode, said control valve indexes in said control valve bore, aligning said middle annulus with said lashless fluid supply circuit and said accumulator control circuit so that said lashless fluid supply circuit and said accumulator control circuit become hydraulically locked and the motion of said cam is translated directly into the motion of said engine valve.

9. The braking system of claim 1, wherein said hydraulic fluid controlling means further comprises an accumulator control circuit and a switched low pressure supply circuit for providing clipping of said valve actuating piston and thereby providing lost motion braking.

10. The braking system of claim 9, further comprising a clipping/reset spool disposed in said cam shaft.

* * * * *